United States Patent [19]

Sciuto

[11] 4,408,515

[45] Oct. 11, 1983

[54] STRINGED INSTRUMENT CONVERSION KIT EMPLOYING COMBINED BRIDGE/TUNING MECHANISM

[76] Inventor: Michael N. Sciuto, 2310 Chetwood Cir., Apt. 101, Timonium, Md. 21093

[21] Appl. No.: 282,545

[22] Filed: Jul. 13, 1981

[51] Int. Cl.[3] ..... G10D 3/04; G10D 3/12

[52] U.S. Cl. ..... 84/267; 84/297 R; 84/298; 84/304; 84/314 N

[58] Field of Search ..... 84/267, 268, 297 R, 84/298, 299, 304–306, 307, 312 R, 312 P, 313, 314 N

[56] References Cited

U.S. PATENT DOCUMENTS

| | | | |
|---|---|---|---|
| 1,595,798 | 8/1926 | Marino | 84/299 |
| 1,721,710 | 7/1929 | Pedersen | 84/267 |
| 1,819,371 | 8/1931 | Kordick | 84/267 |
| 2,519,824 | 8/1950 | Cousineau | 84/312 R |
| 2,523,963 | 9/1950 | Mitchell | 84/267 |
| 2,603,119 | 7/1952 | Dearth | 84/312 R |
| 2,714,326 | 8/1955 | McCarty | 84/299 |
| 2,793,557 | 5/1957 | Stipetic | 84/307 |
| 2,828,660 | 4/1958 | Paulsen | 84/297 R |
| 2,905,042 | 9/1959 | Hoyer | 84/307 |
| 2,972,923 | 2/1961 | Fender | 84/313 |
| 3,163,073 | 12/1964 | Elmore | 84/312 P |
| 3,181,409 | 5/1965 | Burns et al. | 84/313 |
| 3,269,247 | 8/1966 | Connors | 84/267 |
| 3,290,980 | 12/1966 | Fender | 84/307 |
| 3,344,698 | 10/1967 | Ferrara | 84/267 |
| 3,427,916 | 2/1969 | Fender | 84/267 |
| 3,431,807 | 3/1969 | Thompson | 84/306 |
| 3,910,151 | 10/1975 | Copeland | 84/267 |
| 4,007,658 | 2/1977 | Spain | 84/312 |
| 4,031,799 | 6/1977 | Fender | 84/307 |

OTHER PUBLICATIONS

Kramer Guitar Corporation, Inc. 8 String Bass.

*Primary Examiner*—Lawrence R. Franklin
*Attorney, Agent, or Firm*—Saidman, Sterne & Kessler

[57] ABSTRACT

A kit for converting a single-stringed instrument to a double-stringed instrument including a unique combined bridge/tuning mechanism (50) which replaces the bridge assembly of the single-stringed instrument. The combined bridge/tuning mechanism (50) includes a bridge assembly over which both the original strings (20) and the additional strings (40) pass, and an integrally mounted tuning assembly (54) for adjusting the tension in (i.e., tuning) the additional strings. The bridge/tuning mechanism (50) includes a base or mounting plate (60) from one end of which perpendicularly extends a flange (62). The tuning keys (86) which comprise the tuning assembly (54) are pivotally mounted to the upper end of the flange (62), the additional strings (40) passing through apertures (68) formed in the flange (62). The flange (62) also serves as a means for terminating one end of the original strings (20) whose other ends are terminated in other tuning keys (18) located, for example, on the head (16) of the instrument. The bridge assembly (52) preferably includes independently movable and adjustable drums (102) which are mounted between the flange (62) and base plate (60) and include dual groove means for accommodating both the original and additional strings. The remaining portions of the kit include anchor means adapted to be mounted on the head (16) of the instrument for terminating the other ends of the additional strings, and a modified nut (28) which includes additional grooves (30) for accommodating the additional strings.

The combined bridge/tuning mechanism (50) may, of course, be utilized as original equipment in the manufacture of either a double-stringed instrument or a single-stringed instrument, as may be desired.

23 Claims, 9 Drawing Figures

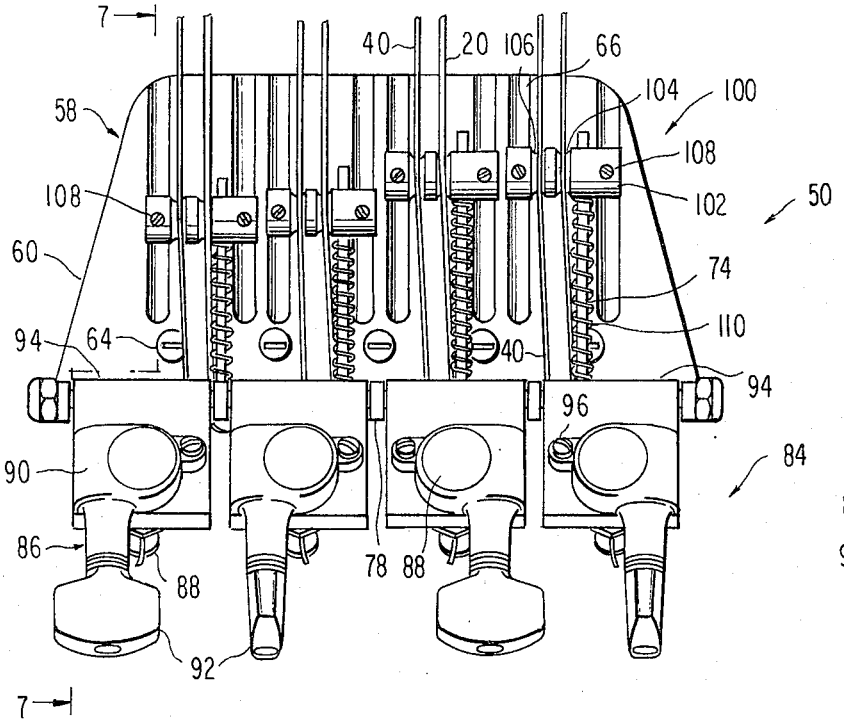
FIG. 4
FIG. 8
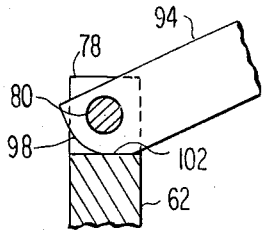
FIG. 7
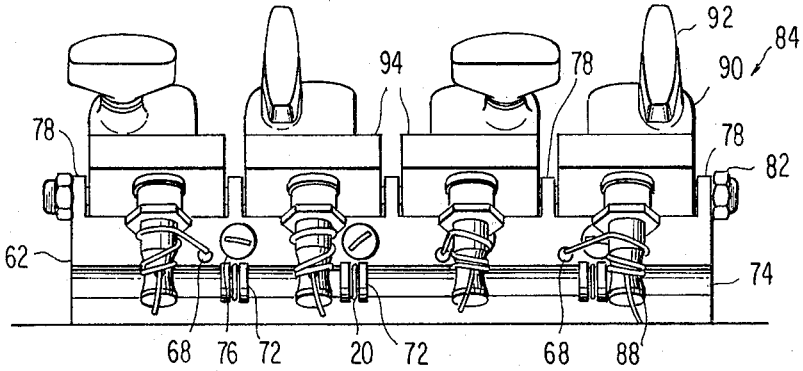
FIG. 5
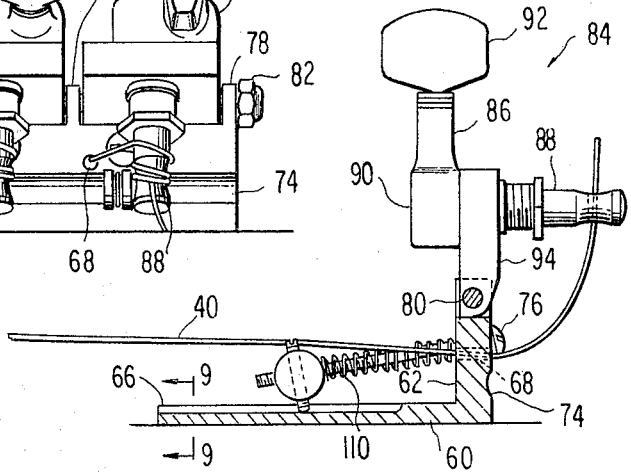
FIG. 9
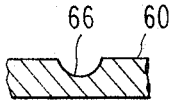
FIG. 6
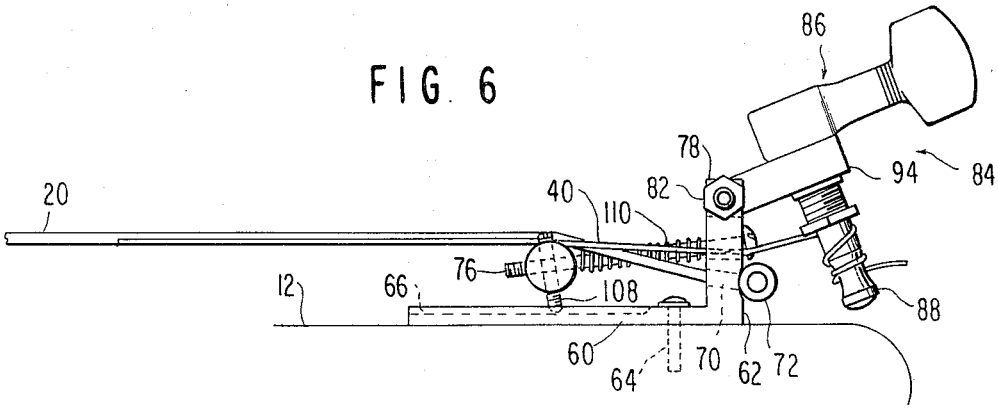

STRINGED INSTRUMENT CONVERSION KIT EMPLOYING COMBINED BRIDGE/TUNING MECHANISM

BACKGROUND OF THE INVENTION

1. Field of the Invention

The present invention is related to stringed instruments and, more particularly, is directed towards bridge and tuning mechanisms utilized with stringed instruments.

2. Description of the Related Art

In order for a stringed instrument to be in tune, the octave point of each string must be aligned with its corresponding octave fret which is located, for example, on the neck of an electric guitar or bass. The octave point of a string is defined by the overall resonant length of the string which is, in turn, defined by the distance between the cross-over point of the string at the nut and the cross-over point of the string at the bridge. As long as the distance between the cross-over points at the nut and the bridge remain constant, the resonant length of the string, and therefore its octave point, also remains constant.

In modern electric guitars, for example, it is realized that the height of each string relative to the neck of the instrument is a matter of personal taste, and many mechanisms have been introduced to permit the height of the strings to be varied as a user may desire. See, for example, U.S. Pat. No. 4,031,799 to Fender. This height adjustment is generally achieved by varying the spacing between the bridge and the body of the instrument by means of, for example, set screws which extend vertically through the bridge sections (also known as drums).

However, it is also known that adjusting the spacing between the bridge and the instrument body undesirably results in a change in the length of each string, which, as stated above, results in a change in the location of the octave point of the string. It has therefore been recognized that in order to maintain the string in tune, it is necessary simultaneously to adjust the lateral position of the bridge (and hence the cross-over point of the associated string) when adjustments are made to the height thereof. This is achieved by providing a plurality of bridge sections or drums which are individually laterally as well as vertically adjustable. See also, for example, U.S. Pat. Nos. 2,972,923; 3,290,980; and 3,427,916.

The individually adjustable bridge designs of the prior art are embodied by precision mechanisms which increase the cost of the stringed instrument but are nevertheless necessary to maintain the instrument in proper tune.

Double-stringed guitars are those provided with a plurality of pairs of strings. Each pair comprises two strings placed close together and played as one string tuned in an octave. The pair of strings produces a tone which cannot be achieved by an ordinary single-stringed instrument. See, for example, U.S. Pat. Nos. 1,721,710; 1,819,371; 3,269,247; and 3,344,698. In each of the double-stringed instruments described in the foregoing patents, one end of the strings are terminated on the body after passing over a bridge, and the other ends thereof are terminated by a plurality of tuning keys located on the head of the instrument after passing over a nut.

Recently, electric guitar manufacturers have marketed double-stringed electric guitars wherein one string of each pair of strings are tuned conventionally by tuning keys mounted on the head of the instrument, whereas the other string of each pair of strings extends across the bridge to be tuned by auxiliary tuning keys mounted to the body of the instrument, as exemplified by Model No. XL8 manufactured by Kramer Guitar Corporation, Inc. of Neptune, N.J. The more modern double-stringed guitars employ, as one would expect, a precision adjustable bridge mechanism (as discussed above) in order to maintain the strings in tune while permitting the musician to adjust the strings of the instrument to suit his taste.

While a double-stringed guitar is a nice adjunct to a musician's inventory of instruments, it is only suitable for certain songs and therefore represents a substantial additional investment. It would therefore be highly desirable if a device or kit could be provided, at relatively low cost, which would permit a musician to readily convert either his own or an older, used single-stringed instrument to a double-stringed instrument, and vice-versa, at will. Such a kit or device would clearly save the tremendous costs incident to purchasing a new double-stringed guitar as opposed to converting an existing, perhaps unused single-stringed guitar.

Such a conversion kit should also preferably be readily compatible with existing guitar designs, which would provide a ready market for the kit. The kit should include means for adding the extra strings and terminating the respective ends thereof in the head and body of the instrument over suitable nut and bridge assemblies, as well as means for tuning the added strings. Finally, the kit should incorporate an adjustable bridge assembly, for the reasons set forth above.

It is towards providing such a kit, and a novel component thereof, that the present invention is advanced.

U.S. Pat. Nos. 2,523,963 and 3,910,151 show guitars wherein the tuning keys are mounted to the body of the guitar, rather than to the neck. However, neither of the instruments shown in these patents are directed towards a double-stringed guitar, and neither suggests the unique combined bridge/tuning mechanism of the present invention as will be set forth in greater detail below.

U.S. Pat. Nos. 3,163,073 and 4,007,658 teach electric steel pedal guitars wherein the strings are mounted on pivotable levers which also contain the tuning keys. No means are provided, however, for an adjustable bridge mechanism since steel pedal guitars are played with a steel bar which, by its nature, does not require vertical or horizontal adjustment of the strings as with a hand-held electric guitar or similar stringed instrument.

OBJECTS OF THE INVENTION

It is therefore a primary object of the present invention to provide a kit for converting a single-stringed instrument to a double-stringed instrument.

Another object of the present invention is to provide a stringed instrument conversion kit which permits a conventional single-stringed instrument (e.g., a four string bass or a six string guitar) to be quickly and easily converted to a double-stringed instrument (e.g., an eight or twelve string guitar) with a minimum of parts, modification to the instrument and expense.

An additional object of the present invention is to provide a conversion kit for stringed instruments which is inexpensive, easy to install, is readily adaptable to existing instrument designs, and which may be utilized to change quickly and easily the instrument back and forth between a single-stringed or double-stringed instrument, as desired.

Another object of the present invention is to provide apparatus which may be utilized in original instrument manufacture for either a single-stringed or double-stringed instrument which combines an adjustable bridge assembly and an adjustable tuning assembly in one mechanism.

A further major object of the present invention is to provide a combined bridge/tuning mechanism which includes means for facilitating termination of the strings in the tuning assembly.

Another object of the present invention is to provide a unique and novel mechanism which combines a plurality of tuning keys and independently adjustable bridge sections in a single, integrally formed unit.

A still further object of the present invention is to provide a new and improved double-stringed guitar.

SUMMARY OF THE INVENTION

The foregoing and other objects are achieved in accordance with one aspect of the present invention through the provision of a kit for permitting additional strings to be added to a stringed instrument. The stringed instrument may include a body, a neck, a head and original strings extending between the head and the body. The kit includes a combination bridge/tuning mechanism adapted to be mounted to the body. The bridge/tuning mechanism includes bridge means adapted to accommodate the original strings and the additional strings, and tuning key means for terminating one end of and for tuning the additional strings. The kit further includes means adapted to be mounted on the head of the instrument for terminating the other ends of the additional strings. The kit also preferably further comprises nut means adapted to be mounted to the neck and having groove means formed therein for accommodating both the original strings and the additional strings.

In accordance with other aspects of the present invention, the bridge means preferably includes a plurality of individually movable drums, each of the drums including groove means for receiving one of the original strings and one of the additional strings. The combination bridge/tuning mechanism more particularly may comprise a base plate adapted to be secured to the body, a flange extending outwardly and integrally from the base plate, a plurality of independently adjustable drums, and a plurality of tuning keys mounted to the flange for tuning the additional strings. Means may also be provided for individually pivotally mounting each of the tuning keys to the flange. The last-named means preferably each comprise a pivot plate having one end pivotally coupled to the flange and through which transversely extends the shaft of a tuning key mounted to the plate. More particularly, each of the drums preferably includes means connecting same with the flange for permitting horizontal adjustment of the position of the drum, as well as screw means extending vertically through the drum for permitting adjustment of the vertical position thereof.

The head of the stringed instrument to be converted normally includes original tuning key means for terminating one end of and for tuning the original strings, while the flange of the combined bridge/tuning mechanism preferably includes means for terminating the other ends of the original strings. The last-named means preferably comprises a groove extending transversely across the rear surface of the flange, the groove adapted to seat original string-terminating eyelets therein.

In accordance with another aspect of the present invention, a method is provided for converting a single-stringed instrument to a double-stringed instrument which comprises the steps of removing the bridge from the single-stringed instrument, replacing the removed bridge with a combined bridge/tuning mechanism, and installing additional strings together with the original strings. The last-named step comprises the steps of terminating one end of the additional strings in the vicinity of the tuning keys for the original strings, passing the additional strings and the original strings over the bridge portion of the combined bridge/tuning mechanism, and terminating the other ends of the additional strings in the tuning assembly of the combined bridge/tuning mechanism. The method further contemplates the step of terminating one end of the original strings in the combined bridge/tuning mechanism, as well as the step of replacing the original nut with a new nut that includes groove means for accommodating the additional as well as the original strings.

In accordance with yet another aspect of the present invention, there is provided a double-stringed instrument which comprises a body, a neck extending from the body, a head connected to one end of the neck, first and second sets of strings extending between the body and the head, a first set of tuning keys mounted to the head for tuning the first set of strings, means mounted on the head for terminating the second set of strings, and a bracket mounted to the body, the bracket having bridge means mounted thereon over which the first and second sets of strings pass, the bracket also having a second set of tuning keys mounted thereon for tuning the second set of strings.

In accordance with a broad aspect of the present invention, there is provided apparatus for a stringed instrument which comprises a support member adapted to be mounted to the stringed instrument, an adjustable bridge over which at least one string of the instrument is adapted to pass, the adjustable bridge being mounted on the support member, and tuning key means mounted on the support member for tuning the one string.

In accordance with yet another aspect of the present invention, there is provided a combined bridge and tuning mechanism for a stringed instrument having a body, a neck and a plurality of strings, which comprises a base adapted to be secured to the body, a flange extending outwardly from the base, a plurality of independently adjustable drums mounted between the base and the flange over each of which at least one of the strings is adapted to extend, and a plurality of tuning keys mounted to the flange and adapted to tune the strings. The tuning keys are preferably individually pivotally mounted to the flange by means of a pivot plate for facilitating termination of the strings therein.

BRIEF DESCRIPTION OF THE DRAWINGS

The foregoing and other objects, aspects, features and advantages of the present invention will be better understood from the following detailed description thereof when considered in conjunction with the accompanying drawings, in which:

FIG. 4 is an enlarged plan view of the combined bridge/tuning mechanism of the present invention of FIG. 1 which illustrates the details thereof;

FIG. 5 is a front view in elevation of the mechanism illustrated in FIG. 4;

FIG. 6 is a side view in elevation illustrating the mechanism of FIGS. 4 and 5 mounted on the instrument body;

FIG. 7 is a sectional view of the mechanism illustrated in FIG. 4 and taken along line 7—7 thereof;

FIG. 8 is an enlarged, fragmentary view of a portion of the apparatus illustrated in FIG. 7; and FIG. 9 is a sectional view taken along line 9—9 of FIG. 7.

DETAILED DESCRIPTION OF THE PREFERRED EMBODIMENTS

Figure 1:
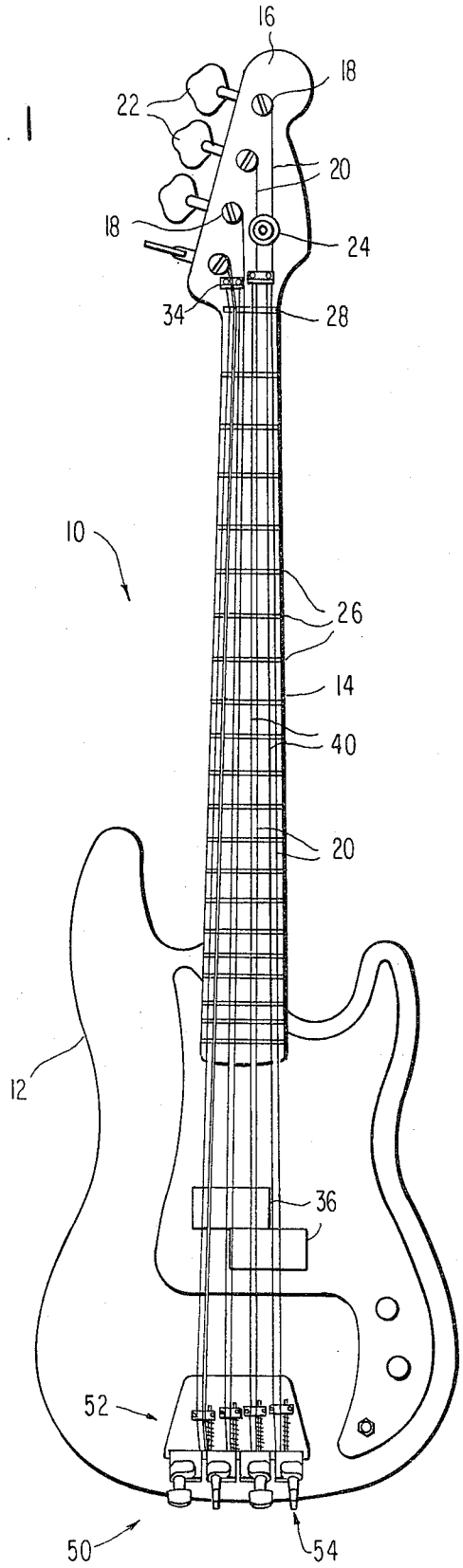
FIG. 1 is a plan view of a stringed instrument which incorporates the combined bridge/tuning mechanism of the present invention.
Figure 2:
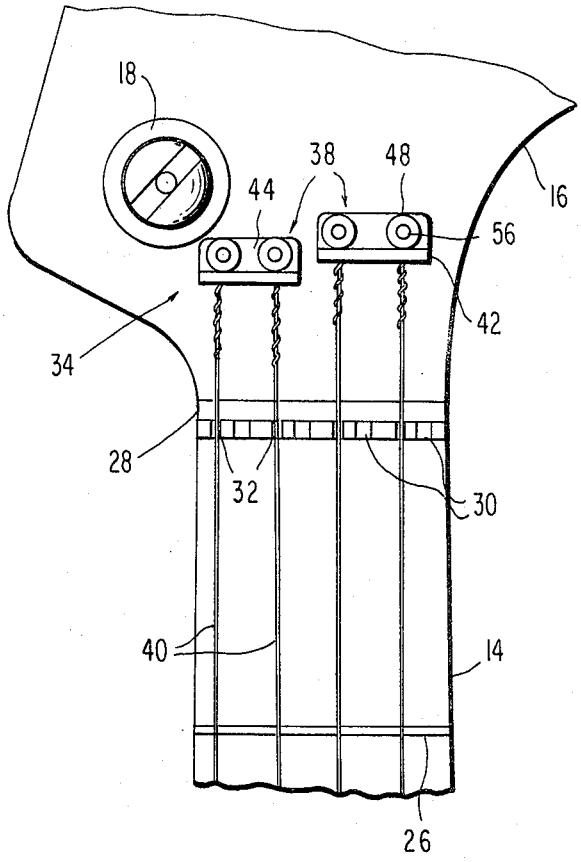
FIG. 2 is an enlarged, fragmentary view showing details of a portion of the instrument of FIG. 1 where the neck meets the head.
Figure 3:
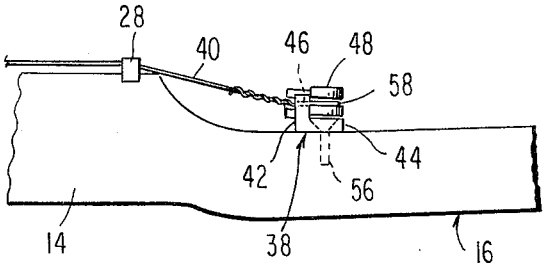
FIG. 3 is a side view of the apparatus illustrated in FIG. 2.

Referring now to the drawings, wherein like reference numerals represent identical or corresponding parts throughout the several views, and more particularly to FIGS. 1–3 thereof, reference numeral 10 indicates a double-stringed instrument having the present invention incorporated therein. While double-stringed instrument 10 is shown for the sake of illustration as comprising an eight string electric bass guitar, it is understood that the principles of the present invention may be utilized with any suitable stringed instrument.

It should also be understood that while an eight string bass guitar is illustrated in FIG. 1, such instrument may in accordance with the present invention be either an original equipment manufacture or may comprise a standard four string electric bass guitar which has been converted to an eight string model by means of the present invention. Similarly, the present invention may be utilized to convert, for example, a six string electric guitar to a twelve string electric guitar, as will become more clear hereinafter. For ease in explanation and to aid in understanding, however, the present invention will be described hereinafter in terms of converting a four string bass to the eight string bass as shown in the drawings.

Instrument 10 includes a body 12, a neck 14 and a head 16. Head 16 includes a plurality, e.g., four, tuning key assemblies 18. The structure of tuning key assemblies 18 is well-known, and one tuning key assembly is provided to adjust the tension in each of the four original low octave strings 20 provided with an ordinary four string bass guitar. Each tuning key assembly 18 includes a rotating shaft to which a string 20 is secured and a thumb button 22 which is mechanically coupled to rotate the shaft, as is conventional.

Neck 14, includes a plurality of frets 26 which are standardly spaced along the neck. At the top of the neck is positioned a nut 28 which, as shown in FIG. 2, includes a plurality of grooves 30 for receiving strings 20 therein (strings 20 are not shown in FIG. 2 for clarity). Nut 28 also includes alternately positioned grooves 32 for receiving four additional strings 40 which are the high octave strings that complement the four low octave strings 20 in an eight string bass guitar.

Strings 40 are terminated on head 16 by anchor members indicated generally by reference numeral 34. As illustrated in FIGS. 2 and 3, anchor members 34 each include a bracket 38 which consists of an upstanding flange 42 extending from a base 44. An aperture 46 is formed in flange 42 through which string 40 extends. String 40 is wrapped about a groove 58 formed in an eyelet 48 for termination. Bracket 38 is secured to head 16 by a mounting screw 56 that extends through a hole in base 44.

Referring back to FIG. 1, a pair of pick-ups 36 are provided in the body 12 over which the strings 20 and 40 extend. Reference numeral 50 indicates generally the combined bridge/tuning mechanism of the present invention which will be described in greater detail hereinafter. Basically, mechanism 50 includes a bridge assembly 52 for resonant termination of strings 20 and 40, and a tuning key assembly 54 for physically terminating strings 20 and permitting adjustment in the tension (i.e., tuning) of strings 40, in a manner which will become more clear hereinafter.

It should be noted that the combined bridge/tuning mechanism 50 is preferably sized to enable it to replace a standard bridge assembly of a four string bass guitar to convert it to an eight string guitar. A kit for enabling such a conversion would include the bridge/tuning mechanism 50, the nut 28, and the anchor members 34. In converting a four string guitar to an eight string guitar, the lower ends of the original four strings 20 are first released from the old bridge. The old bridge is then removed from the body of the instrument, and is replaced by the combined bridge/tuning mechanism 50. The nut 28 replaces the old nut, and brackets 38 are installed in the head 16 by suitable mounting screws. The old strings 20 are then strung through the mechanism 50, as will be explained hereinafter, and the new strings 40 are strung through the brackets 58 over the nut 28, across the bridge assembly 52 and are terminated in the tuning key assembly 54.

Referring now to FIGS. 4–9, the structural details of the combined bridge/tuning mechanism 50 of the present invention will now be explained. Mechanism 50 comprises a support member or mounting bracket indicated generally by reference numeral 58. Support member 58 comprises a base plate 60 from the rear edge of which is integrally formed a vertically extending flange 62 which is preferably substantially perpendicular to the plane of base plate 60.

Base plate 60 is adapted to be secured to the outer planar surface of instrument body 12 by means of a plurality of screws 64 that extend through suitably positioned apertures formed in plate 60. Again, it is noted that plate 60 is preferably designed so as to be interchangeable with existing bridge mounting plates of standard single-stringed instruments. Base plate 60 further may include a plurality of pairs of grooves 66 which extend from the front edge of the plate rearwardly as shown best in FIG. 4. In the illustrated embodiment, wherein a four string bass guitar is converted to an eight string bass guitar, four pairs of grooves 66 are provided.

Flange 62 includes, as best seen in FIGS. 5–7, a first series of apertures 68 through which the additional high octave strings 40 pass. Flange 62 further includes a second series of apertures 70 through which the original, low octave strings 20 extend. Strings 20 are terminated about eyelets 72 which seat in a lateral groove 74 formed across the rear surface of flange 62.

A third series of apertures (not shown in the drawings) are positioned just above apertures 70 and are adapted to receive a plurality of lateral harmonic adjusting screws 76, the purpose of which will be described in greater detail hereinafter.

Flange 62 also has formed along the top edge thereof a plurality of mounting posts 78 which have transverse apertures formed therein to receive a pivot pin 80 which is secured at its ends by securing devices 82.

Mounted for rotation about pin 80 are a plurality of tuning key assemblies indicated generally by reference numeral 84. Four such tuning key assemblies 84 are illustrated, one for each of the four additional high octave strings 40. Each tuning key assembly 84 includes, for example, a standard tuning key 86 which is normally manufactured as a unit and includes a shaft 88, a worm gear housing 90 and a thumb button 92. Rotation of thumb button 92, in turn, rotates shaft 88 through the gears in housing 90, as is conventional.

The tuning key assemblies 84 further include a mounting plate 94 having a pivot aperture extending longitudinally along one edge thereof for receiving pivot pin 80. Each tuning key 86 is secured to a respective mounting plate 94 by means of shaft 88 extending through the plate and with the assistance of auxiliary screw 96. p Plate 94 is adapted to be rotated between a first position illustrated, for example, in FIG. 7, and a second position illustrated, for example, in FIG. 6. The first position of FIG. 7 corresponds to the stringing position for the tuning key 86 and may be characterized by the fact that shaft 88 is substantially perpendicular to plate 62. The second position of FIG. 6 corresponds to the playing position for the instrument wherein tuning key assembly 84 has been rotated clockwise from the position shown in FIG. 7. The FIG. 6 position may be characterized in that shaft 88 is almost parallel with plate 62, although it is important to design the apparatus so that shaft 88 does not touch body 12 in its operative position as shown in FIG. 6.

In stringing the additional strings 40, each is initially passed over its associated drum and then through its respective aperture 68 in flange 62. The associated tuning key assembly 84 is then rotated to its first position as shown in FIG. 7 whereby the shaft 88 of tuning key 86 is made readily manually accessible. The end of the string 40 is then inserted in a hole formed in shaft 88, also as shown in FIG. 7. Thumb button 92 is then turned which acts to rotate shaft 88 and thereby draw string 40 thereabout. As the string 40 is further tensioned by additional rotation of button 92, tuning key assembly 86 will automatically rotate about shaft 80 towards and until it reaches the position shown in FIG. 6. The string 40 may be further tightened as may be necessary for proper tuning thereof.

To limit movement of tuning key assemblies 84 between the positions of FIGS. 6 and 7, the lower edge 98 of plates 94 (see FIG. 8) are machined to form stop members which abut the upper edge 102 of flange 62 to limit the rotation of plate 94 in both the counterclockwise and clockwise direction (compare FIG. 7 and FIG. 8).

Referring back to FIG. 4, reference numeral 100 indicates a substantially conventional bridge assembly. The bridge assembly 100 includes a plurality of individually adjustable or movable saddles or drums 102. Each drum 102 includes a pair of grooves 104 and 106 formed thereabout. Each groove 104 is adapted to have a low octave string 20 pass thereover, while each groove 106 is adapted to have a high octave strings 40 pass thereover.

Each drum 102 is movable independently of the other drums both vertically and horizontally. A pair of height adjusting set screws 108 extend vertically through each drum 102. The lower ends of screws 108 lie in the pair of grooves 66 formed in base 60. Set screws 108 raise and lower the associated drum so that the spacing between the strings and the neck may be adjusted to the user's desire.

Each drum 102 also includes a lateral harmonic adjustment screw 76 extending horizontally through the drum to permit the drum's position to be horizontally or laterally adjusted to, in effect, change the resonant length of the associated string to permit exact octave point alignment with the octave fret on the neck. Screws 76 also extend through apertures 70 of flange 62, as noted above. Springs 110 are mounted about screws 76 to urge the drums 102 away from flange 62 so that the heads of the screws 76 remain in contact with flange 62.

It is clear from the foregoing that there is provided a novel mechanism which combines both an adjustable bridge assembly and a tuning assembly for easily permitting a conventional single-stringed instrument to be converted to a double-stringed instrument. The provision of the combined mechanism in standardized sizes permits present owners of conventional single-stringed instruments to convert same to double-stringed instruments without having to invest in an entirely new instrument. There also exists a ready supply of relatively inexpensive, used single-stringed instruments, which, with the present invention, may find extended lives and usefulness as double-stringed instruments.

It should also be appreciated that the combined bridge/tuning mechanism of the present invention may be utilized as original equipment for either a double-stringed instrument, or a single-stringed instrument. In the latter case, the conventional head and tuning keys mounted thereon may be dispensed with, thereby saving additional costs. The strings simply are terminated by anchor members 34 or the like, after they pass over a suitable nut, while the other ends of the strings are terminated in the tuning assembly of the combined mechanism after passing over the bridge assembly.

The provision of a single mounting bracket onto which both a bridge assembly and a tuning key assembly are mounted is economical, simple to install, and obviates any alignment problems which may be caused by separating the tuning keys from the bridge. Further, the present invention obviates the expensive requirement of the prior art instruments of mounting the tuning keys directly to the body.

The individually rotatable tuning key assemblies in the combined bridge/tuning mechanism permits each string tuned thereby to be individually strung by rotating the tuning key to its vertical position, thereby making manipulation of the string very easy.

Further, by providing the tuning keys integral with the bridge assembly on the body of the instrument, tuning of the strings in a single-stringed instrument may be accomplished without constantly shifting the left hand between the neck and the tuning keys on the head as required by prior art designs.

Obviously, numerous modifications and variations of the present invention are possible in light of the above teachings. It is therefore to be understood that within the scope of the appended claims, the invention may be practiced otherwise than as specifically described herein.

I claim as my invention:

1. A double stringed instrument, which comprises:
a body;
a neck extending from said body;
a head connected to said neck;
first and second sets of strings extending between said body and said head;
a first set of tuning keys mounted to said head for tuning said first set of strings;
means mounted on said head for terminating said second set of strings; and
a bracket mounted to said body, said bracket having bridge means mounted thereon over which said first and second sets of strings pass, said bracket also having a second set of tuning keys mounted thereon for tuning said second set of strings.

2. An instrument as set forth in claim 1, further comprising means for individually pivotally mounting each of said second set of tuning keys to said flange.

3. An instrument as set forth in claim 2, wherein said individually pivotally mounting means each comprise a pivot plate having one end pivotally coupled to said flange and through which transversely extends the shaft of one of said second set of tuning keys mounted to said plate.

4. An instrument as set forth in claim 1, wherein said bridge means includes a plurality of individually movable drums, each of said drums including groove means for receiving one of said first set of strings and one of said second set of strings.

5. An instrument as set forth in claim 1, wherein said bracket comprises:
a base plate adapted to be secured to said body;
a flange extending outwardly from said base plate;
a plurality of independently adjustable drums mounted between said base plate and said flange and over each of which at least one of said first set of strings and one of said second set of string passes; and
said second set of tuning keys being mounted to said flange for tuning said second set of strings.

6. An instrument as set forth in claim 5, wherein each of said drums includes means connecting same with said flange for permitting horizontal adjustment of the position of said drum.

7. An instrument as set forth in claim 5, wherein said flange includes means for terminating the other ends of said first set of strings.

8. An instrument as set forth in claim 7, wherein said means for terminating the other ends of said first set of strings comprises a groove extending transversely across said rear surface of said flange, said groove adapted to seat string-terminating eyelets therein.

9. An instrument as set forth in claims 4 or 5, wherein each of said drums includes screw means extending vertically therethrough for permitting vertical adjustment of the position of said drum.

10. A kit to permit additional strings to be added to a stringed instrument having a body, a neck, a head and original strings extending between said head and said body, which comprises:
a combination bridge/tuning mechanism adapted to be mounted to said body, said bridge/tuning mechanism including bridge means adapted to accommodate said original strings and said additional strings, and tuning key means for terminating one end of and for tuning said additional strings; and
means adapted to be mounted on said head of said instrument for terminating the other end of said additional strings.

11. A kit as set forth in claim 10, further comprising nut means adapted to be mounted to said neck and having groove means formed therein for accommodating both said original strings and said additional strings.

12. A kit as set forth in claim 10, wherein said bridge means includes a plurality of individually movable drums, each of said drums including groove means for receiving one of said original strings and one of said additional strings.

13. A kit as set forth in claim 10, wherein said mechanism comprises:
a base plate adapted to be secured to said body;
a flange extending outwardly from said base plate;
a plurality of independently adjustable drums mounted between said base and said flange and over each of which at least one of said original strings and one of said additional strings pass; and
a plurality of tuning keys mounted to said flange for tuning said additional strings.

14. A kit as set forth in claim 13, further comprising means for individually pivotally mounting each of said tuning keys to said flange.

15. A kit as set forth in claim 14, wherein said individually pivotally mounting means each comprise a pivot plate having one end pivotally coupled to said flange and through which transversely extends the shaft of a tuning key mounted to said plate.

16. A kit as set forth in claim 13, wherein each of said drums includes means connecting same with said flange for permitting horizontal adjustment of the position of said drum.

17. A kit as set forth in claim 13, wherein said head includes original tuning key means for terminating one end of and for tuning said original strings.

18. A kit as set forth in claim 17, wherein said flange further includes means for terminating the other ends of said original strings.

19. A kit as set forth in claim 18, wherein said means for terminating the other end of said original strings comprises a groove extending transversely across said rear surface of said flange, said groove adapted to seat string-terminating eyelets therein.

20. A kit as set forth in claims 12 or 13, wherein each of said drums includes screw means extending vertically therethrough for permitting vertical adjustment of the position of said drum.

21. A method of converting a conventional single stringed instrument to a double stringed instrument, said single stringed instrument consisting of a head having original tuning means mounted thereon, a neck, a body having an original bridge mounted thereon, and original single strings being connected to said original tuning means and extending over said neck and said original bridge, comprising the steps of:
mounting anchor means in the vicinity of said original tuning means,
removing said original bridge,
installing a combined bridge/tuning mechanism on said body, said mechanism comprising a new bridge and additional tuning means, and
installing additional strings together with said original strings on said instrument, said additional strings being connected at one end to said anchor means and at the other end to said additional tuning means, said additional strings extending over said new bridge and said neck adjacent said original single strings, thereby forming said double stringed instrument.

22. The method of claim 21 further including the steps of:

removing the original nut from said neck, and installing a new nut having groove means thereon for receiving said single strings and said additional strings.

23. A method as set forth in claim 21, wherein said string installing step further comprises the step of terminating one end of the original strings in said combined bridge/tuning mechanism.

* * * * *